United States Patent [19]

Kniepkamp et al.

[11] 4,244,260

[45] Jan. 13, 1981

[54] FOOTAGE VOLUME CONTROL CIRCUIT

[75] Inventors: Alberto Kniepkamp, Arlington Heights; Douglas R. Moore, Vernon Hills, both of Ill.

[73] Assignee: Norlin Industries, Inc., Deerfield, Ill.

[21] Appl. No.: 974,052

[22] Filed: Dec. 28, 1978

[51] Int. Cl.[2] ..... G10H 1/06; G10H 5/10

[52] U.S. Cl. ..... 84/1.21; 84/1.22; 84/1.19; 84/1.01; 84/1.27

[58] Field of Search ..... 84/1.01, 1.03, 1.11, 84/1.12, 1.19, 1.21, 1.22, 1.23, 1.27

[56] References Cited

U.S. PATENT DOCUMENTS

| | | | |
|---|---|---|---|
| 3,610,799 | 10/1971 | Watson | 84/1.01 |
| 3,755,608 | 8/1973 | Deutsch | 84/1.01 |
| 3,894,463 | 7/1975 | Rocheleau | 84/1.01 |
| 3,902,397 | 9/1975 | Morez et al. | 84/1.01 |
| 3,935,781 | 2/1976 | Katoh et al. | 84/1.11 |
| 4,106,383 | 8/1978 | Dittmar | 84/1.01 |
| 4,129,055 | 12/1978 | Whittington et al. | 84/1.03 |
| 4,149,440 | 4/1979 | Deforeit | 84/1.21 |

*Primary Examiner*—J. V. Truhe
*Assistant Examiner*—William L. Feeney
*Attorney, Agent, or Firm*—Jack Kail; Ronald J. Kransdorf

[57] ABSTRACT

This is an electronic organ drawbar circuit in which selection of the footage volumes is accomplished by means of a switch matrix; and sets of footage/volume correlations so chosen are stored in a memory. Another group of switches is used to select among several different memory fields, so that various sets of footage/-volume data can be stored while another set of data is in use, and each stored set can be recalled for subsequent re-use.

15 Claims, 3 Drawing Figures

16
32
90
50
44
LATCH
D-A CON.
34a
40
92
46
48
PPM/PAM DATA OUT
LSD
MSD
D
C
Q
91
8R
4R
2R
R
98
94

FOOTAGE VOLUME CONTROL CIRCUIT

This invention relates generally to electronic musical instruments; and particularly to organs and other keyboard instruments.

BACKGROUND AND PRIOR ART

This invention is concerned generally with individual control of footage volumes in electronic organs. One particular application of the invention is to organs employing a dual-encoded data format in which a pulse stream is both pulse-position-modulated (PPM) and pulse-amplitude modulated (PAM); i.e. instruments in which a musical note is encoded in pulse position form and the amplitude of the pulse corresponds to the sound volume of the note.

An electronic instrument of this type, specifically an organ, is described in detail in U.S. Pat. No. 3,902,397of Morez and Moore, which is assigned in common with the present application. In general terms, that instrument employs a clock-driven counter and decoder to scan the organ keyboard. Different time slots in the scan cycle represent different musical notes, because the key corresponding to any given note is always interrogated at the same time point in each scan cycle. If the key in question is actuated at the time it is interrogated, a pulse will appear in the scan output at the particular time position which represents the corresponding musical note. Thus, the note selection data derived by scanning the keyboard is pulse-position-modulated.

One of the advantages of this pulse position code format is that the keyboard data pulse train can be enriched with pulses representing various harmonics of the keyboard-selected notes, with but a single key actuation. This is accomplished in the organ of the Morez and Moore patent by passing the scan output, i.e. the keyboard data pulse train, through a shift register (referred to as the pitch shift register). This shift register is in effect a delay line. As each key-actuation pulse passes through successive shift stages, it can be picked off and reinserted in the pulse train at any desired subsequent time slot to represent various harmonics of the original note.

When superimposed upon this pulse-position-modulated scheme, the pulse amplitude technique for encoding of sound volume permits the volumes of the fundamental note and the various selected harmonics to be adjusted independently of each other. Each time a given key-actuation pulse is reinserted into the data train, its amplitude can be increased or decreased as desired. This raises or lowers the sound volume of the particular harmonic represented by that insertion pulse, without in any way affecting, or being affected by, the pulse amplitude (sound volume) of the fundamental note or any of the other pulse insertion harmonics.

In the organ of the Morez and Moore patent, the individual pulse amplitudes (and hence the harmonic sound volumes) are controlled by certain reference voltage levels. The circuit which supplies these volume control voltages is called a drawbar circuit. The particular drawbar circuit in the Morez and Moore patent, illustrated in FIG. 5 thereof, has certain limitations. It offers three sound volume control voltages for each harmonic selected, one of which is adjustable by the musician. The other two are set at the factory, and are not convenient to change. If the adjustable volume setting for one or more harmonics needs to be changed temporarily, there is no way to store and later recall the previous setting. For example, in order to achieve a particular balance of sound volumes among, e.g. nine different harmonics, the musician must balance nine different potentiometer settings. Then if the potentiometer settings are temporarily changed to suit different musical conditions, the labor of resetting the original volume balance must later be performed all over again. In addition, the potentiometer settings are sliding scale adjustments, i.e. analog rather than digital. As a result, it is not possible to know when one has exactly duplicated any previous setting, and the musician must always settle for an approximation.

BRIEF SUMMARY OF THE INVENTION

The present invention comprises an improved drawbar circuit which overcomes these disadvantages. It offers a large number of volume settings for each footage, or musical harmonic. It permits a number of different volume balance settings to be taken out of use, stored, and then recalled for subsequent reuse, without having to duplicate the original labor of creating the balance settings. And it sets each footage volume at a precisely determined discrete level, which is digitally specified and thus exactly duplicable at a later time when recalled from storage. There are no sliding scale settings to "tune" by approximation.

The invention realizes these objectives by providing a manual switch matrix for selecting a set of correlations between two independent variables, such as musical pitch and sound volume. A first axis of the matrix represents a first variable, such as the musical harmonic. The second axis of the matrix represents a succession of pulse amplitudes (or sound volumes). For each musical harmonic the organ player selects one of a group of switches representing a choice among different pulse amplitudes (or sound volumes). Successive groups of matrix switches are interrogated, the switches of each group all having the same x-coordinate value. A read/-write memory is provided, into which the matrix-generated data correlations are entered, and from which they are later read out. The memory output goes to one or more digital/analog converters which convert each digitally specified pulse amplitude (or sound volume) into a voltage analog form, which is then used directly or indirectly to control sound volume.

In a preferred embodiment of the invention, the memory has sufficient capacity for several different sets of footage/volume or other data correlations, and each set is stored in a different memory address field. Selection of the appropriate field, by means of a set of continuously closed, continuously open switches, then recalls for immediate use a set of data correlations previously stored therein.

A detailed description of several preferred embodiments of the invention will now be given, in connection with the following drawings:

DRAWINGS

DETAILED DESCRIPTION OF THE PREFERRED EMBODIMENT

Figure 1:
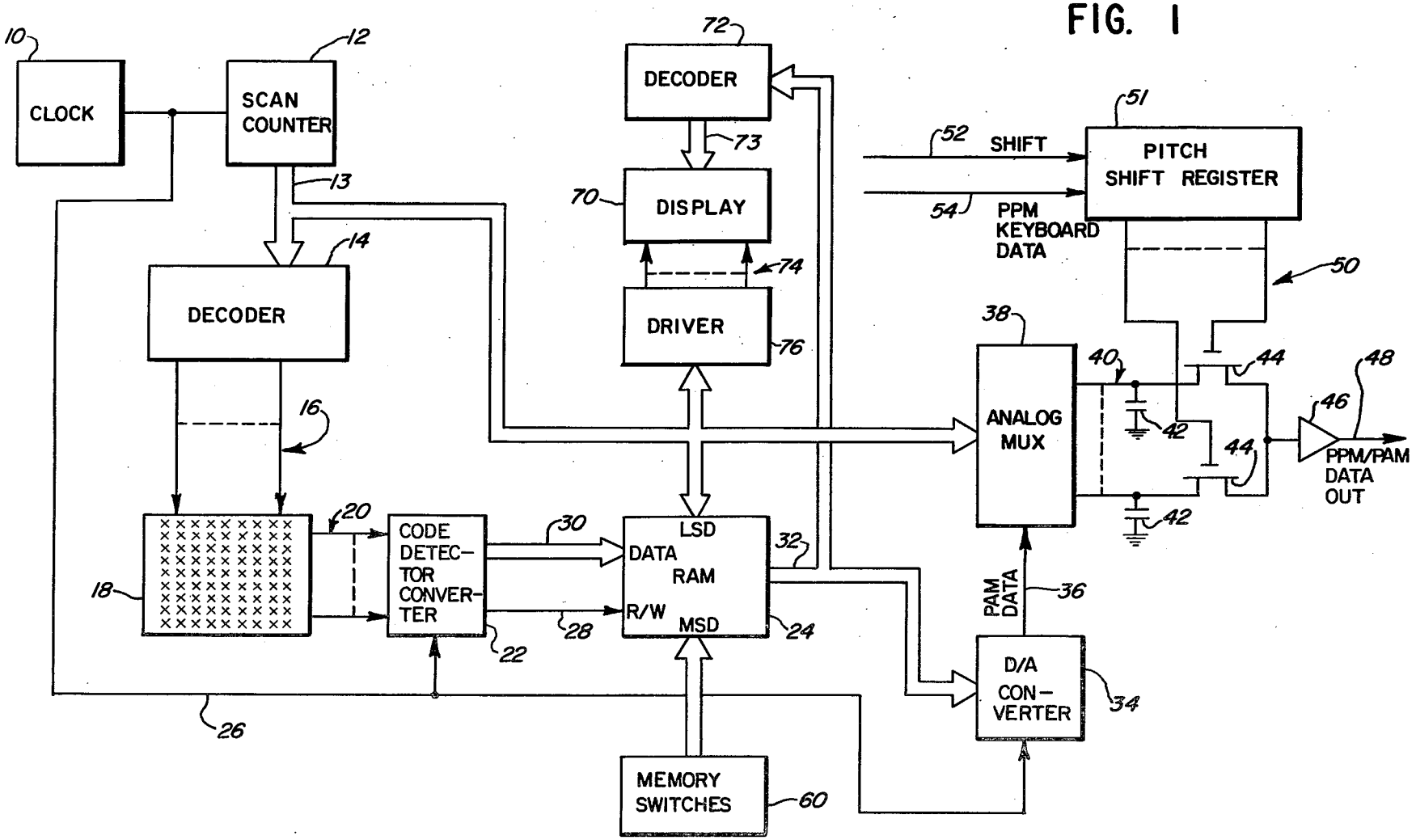
FIG. 1 is a functional block diagram of an improved drawbar circuit in accordance with this invention, specifically designed for use in the organ of the Morez and Moore patent.

The improved drawbar circuit illustrated in FIG. 1 has a clock 10 which develops a high frequency pulse train and repeatedly drives a counter 12 through its sequence of binary code count states. Successive binary code count outputs of the counter 12 are sent over a cable 13 to a decoder 14, and each decoded to a different one of, for example, nine different output lines 16. Each of the output lines 16, as it is selected by the decoder 14, energizes a columnar group of switches in a matrix 18.

The matrix 18 has a plurality of manually operable switches rectangularly organized into an x-y coordinate pattern. Successive steps along the x axis represent successive orders of musical harmonic values. In a preferred embodiment, the first position along the x axis (i.e. the first column of the matrix) represents the first subharmonic of the fundamental tone, i.e. an octave below the note selected at the keyboard; while the second position along the x axis (the second column of the matrix) represents the keyboard note itself, i.e. the fundamental; and the fourth position (fourth column) represents the first order harmonic, i.e. the octave above the keyboard-selected note. In pipe organ terminology, these three tones are the sixteen foot, eight foot and four foot tones, respectively. The third column represents a footage intermediate between the four and eight foot tones, while positions successively further out along the x axis represent successively smaller footages (higher order harmonics) of the selected note, as follows:

| Matrix Column No. | 1 | 2 | 3 | 4 | 5 | 6 | 7 | 8 | 9 |
|---|---|---|---|---|---|---|---|---|---|
| Footage | 16′ | 8′ | $5\frac{1}{3}$′ | 4′ | $2\frac{2}{3}$′ | 2′ | 1 3/5′ | $1\frac{1}{3}$′ | 1′ |

Each columnar group of switches thus represents a given footage, or order of musical harmonic. Within each columnar group, the different rows, or y-coordinate positions, represent different sound volume settings, ranging in discrete steps from zero up to some maximum level. The zero volume level is selected for a given order harmonic or footage when it is desired that it not be heard at all; and the various other volume levels are assigned to the various orders of harmonics, or footages, in accordance with the particular balance of harmonic tones desired by the organist at any given time. In a preferred embodiment, the first row of matrix switches represents zero volume, and there are eight other rows successively representing eight discrete, successively higher volume levels which can be selected for each footage.

The switches of matrix 18 may be any manually operable, momentary contact devices; but the capacitive touch and pressure-sensitive types of switch are preferred for this application because the light actuation pressure required permits the matrix to be operated by tracing the desired curve of volume vs. footage across the face of the matrix with one finger.

Individual row output lines 20 emanating from the matrix 18 represent the respective volume settings. Since the decoder 14 interrogates successive column input lines 16 in successive time slots, a pulse output appearing on a given row output line 20 indicates that the particular volume setting represented by that particular row output line 20 has been assigned to the particular footage corresponding to the time slot in which that pulse appears.

A code detector and converter 22 is then used to translate each footage/volume correlation appearing on the lines 20 into a suitable digital code format for entry into a read/write memory 24. Synchronization is accomplished by means of line 26 going from the clock 20 to the code converter 22. At each relevant time point of the scan counter cycle, the clock pulse appearing on line 26 strobes the code converter 22, alerting the latter to the fact that the matrix 18 may then be sending a message concerning the musician's choice of sound volume for the particular footage which corresponds to that stage of the count cycle. If the musician happens at that instant to be momentarily closing one of the switches in the matrix 18, and if that switch is in the particular column which is then energized by decoder 14, a signal is transmitted over the associated row line 20 to the code converter 22. When a matrix output on any of the lines 20 is detected by circuit 22, a signal appears on line 28 going to the read/write cycle control input of the memory 24. This signal puts the memory in its write mode, causing it to store the digital code output of circuit 22, which is received over a data cable 30 going to the memory's data input. When there is no code detection signal on the line 28, the memory 24 remains in the read-out mode.

In the case of the simultaneous closure of two or more matrix switches in the same column, the converter 22 is set up to give automatic priority to the highest-volume-representing input.

Each time it receives such a signal during a write cycle, the memory 24 stores the matrix-generated information (or alters any previously stored information to correspond with the latest message received from matrix 18). Each data entry in the memory correlates a given footage with a particular sound volume selected for that footage. A full set of data correlations includes a selected one of, say, nine volume levels (including zero) for each of the footages in the table set forth above.

On read-out cycles of the memory 24 the stored footage/volume correlations for all the footages are successively transmitted in digital code form over cable 32 to a digital-to-analog converter 34. The latter circuit converts each successively arriving digital code into a pulse amplitude form, and sends the resulting pulses successively out over a single line 36. Thus each volume setting specified by the memory 24, in digital code format, is restated by the converter 34 in voltage analog (pulse-amplitude-modulated) form. The amplitude-modulated pulses arrive in turn at an analog multiplexer 38, which distributes them over successive output lines 40.

Scan counter information arriving over cable 13 serves to synchronize the memory read-out cycles with the operation of the analog multiplexer 38, so that the pulse occurring in any given time slot of the matrix scan is distributed to the particular output line 40 which represents the corresponding footage.

The analog multiplexer output lines 40 distribute the amplitude-modulated pulses to respective voltage-holding capacitors 42, so that each capacitor retains a voltage level representative, in an analog sense, of the desired sound volume for the particular footage to which that line 40 and capacitor 42 correspond. The voltage analog information contained in the capacitors 42 persists until altered, because it is refreshed on every successive read-out cycle of the memory 24 until, of course, the memory output itself is changed. In successive intervals during each keyboard scan, the respective capacitor voltage levels are connected by respective FET switches 44 to a common buffer stage 46 and output line 48. The FET switches have their gates connected to respective control lines 50 emanating from individual stages of a shift register 51.

Shift register 51 corresponds to the pitch shift register 201–206 which appears in FIGS. 4 and 5 of the Morez and Moore organ patent cited above. That shift register receives the output of the keyboard scan, a PPM keyboard data pulse train on line 54, and is used to develop the time-delayed pulses which are reinserted into the keyboard data pulse train at earlier or later time positions to create various subharmonics and harmonics (footages) relative to each fundamental note selected at the keyboard.

Each individual position-modulated musical note data pulse on line 54 is entered into the first stage of the shift register 51, and appears on the particular output line 50 which emanates from that first stage. That same pulse is then shifted through successive stages of the register 51, as a result of a clock drive appearing on line 52 to the shift input of register 51. Thus the same pulse subsequently appears on the output lines 50 emanating from successive shift stages of register 52 during successive time points in the keyboard scan cycle. Each time that the same pulse appears on yet another output line 50, it represents a different musical note, by virtue of the fact that such appearances occur successively later in the scan cycle, and, in the pulse position code format of Morez and Moore, time represents musical value. It follows that, if the pulse outputs of any two or more of these shift register outputs on lines 50 are logically AND'ed in some manner, so that they appear in successive time intervals on a common output line, such as output line 48, then the signal on line 48 will be a train of two or more successive keyboard data pulses representing two or more musical notes sounded simultaneously.

In the footage volume control circuit of this invention, the particular shift register stages to be AND'ed in this fashion are chosen so that their time delay intervals represent, in the PPM code of Morez and Moore, harmonic relations between notes corresponding to the desired footages. This choice is made by deciding to which of the shift register stages the output lines 50 shall be connected. For any musical note selected by a key actuation, the first of the output lines 50 (in shift register order) represents the first subharmonic, or sixteen foot tone, for the particular keyboard-selected note; and similarly each of the other lines 50 represents one of the smaller footages in the table above. The required logical AND function of tying the shift register lines 50 together is performed by the FET switches 44, collectively, acting as a multi-input gate.

The output appearing on line 48 is a combination position-modulated and amplitude-modulated pulse stream in which the position (timing) of each pulse represents a note (footage) to be played, and the amplitude of that pulse represents the sound volume at which that footage is to be played. This output is utilized, in the context of the Morez and Moore patent, by the sample and hold circuits 62–65 seen in FIG. 1 of that patent.

The present invention has the ability to store a number of different notes of footage/volume correlations, so that once a desired balance of footage volumes has been achieved, it can later be recalled and re-used even though a different balance of footage volumes has been used in the interim. To accomplish this, the memory 24 is provided with several times the capacity required for storing a single set of footage/volume correlations, and is divided into several different data fields, each one having sufficient memory capacity for a full set of footage/volume correlations. Which particular memory data field is selected to be connected to the code converter 22 for data input on write cycles, and to the D/A converter 34 for data output on read-out cycles, depends on the choice of the most significant digits (MSD) of the memory access address, which is accomplished by a set of manually operable switches 60. These switches can be of the familiar pushbutton or "piston" type which remain continuously closed or continuously open until reset, and are also mechanically interlocked so that closing one of them opens all the others. Alternatively, the switches can be of the momentary type; but in that case they must be electronically interlocked, for example, by a ring of mutually coupled flip-flops, so that when any switch is activated it cancels the previous setting. Such electronic interlock circuits are well known. Thus, the organist can push one of the buttons in the switch bank 60 to select a particular field of memory addresses to the exclusion of all others, and that field remains "on line" continuously until another button is pushed.

If there is no footage/volume correlation data yet entered into the selected memory field, or if the organist desires to change the correlations previously stored there, then he uses the momentary switches in the matrix 18 to enter the desired data into the selected memory field. During the entire time that a particular memory field is selected, i.e. while a particular set of most significant memory address digits is continuously in effect because of the present setting of the memory switches 60, the less significant digits of the memory address are cycled by the revolving digital code arriving on cable 13 from the scan counter 12. Thus, the selected (or changed) set of data correlations is written into a set of successive addresses within the selected memory field. Once a set of data correlations has been stored (or changed), the succession of particular addresses from which such data is retrieved during read-out cycles of the memory 24 is similarly determined by the progression of scan counter states, but always within the address field continuously specified by the switches 60.

Whenever the switches 60 are operated to select a new memory field, all subsequent writing in and reading out of footage/volume correlations will be done in the latter field, while the set of footage/volume correlations already entered and stored in any previously selected memory field remains there, subject to future recall and reuse at any time by merely returning the memory switches 60 to their earlier state. When so recalled, the earlier stored data need not be re-entered. Indeed, no further attention to the data selection switch matrix 18 need be paid at all, unless the organist wishes to change the stored settings. Since the switches of matrix 18 are of the momentary type, if they are not touched once again, they will not alter the previously stored data when any previously filled memory field is reactivated by the memory switches 60.

Because the matrix switches 18 are momentary, however, they cannot be employed to give any indication of the particular footage/volume correlations stored in any of the memory fields. Therefore, a display 70 is provided to perform that function. The data read-out of the particular memory field which is selected by switches 60 at any given time is sent over cable 32 to a decoder 72, which then converts that information into a display segment selection code format (cable 73). The display includes a separate digit (or set of digits) to indicate the selected volume level for each of the footages. A separate display drive line 74 comes into the display 70 to energize each such volume digit (or set of volume digits) from a display driver circuit 76. The drive lines 74 are strobed in succession by the driver 76, in step with the scan counter information fed to the driver 76 over cable 13, thus assuring synchronism with the rest of the system.

Figure 2:
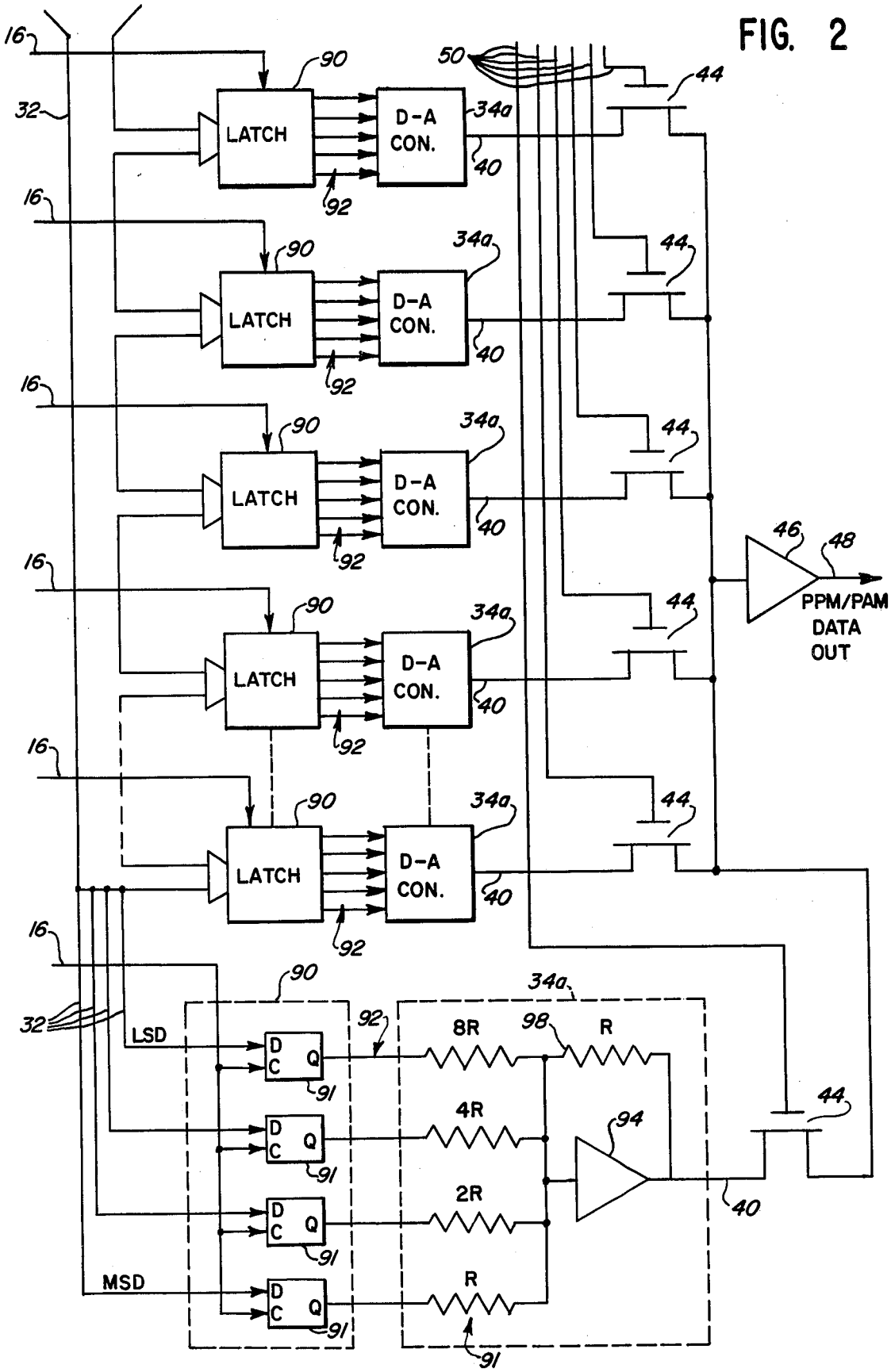
FIGS. 2 and 3 are functional block diagrams representing respective modifications of the circuit in FIG. 1.

In the alternative embodiment of FIG. 2, the analog multiplexer 38 of FIG. 1 is eliminated entirely, and the single digital-to-analog converter 34 of FIG. 1 is replaced by a plurality of such circuits 34*a*, one for each of the footages. The memory output data in digital form on cable 32 (see FIG. 1) is fed to a series of four-bit latches 90, one for each of the footages. Each latch 90 comprises four D-type flip-flops 91. The data on cable 32 is a four-bit digital word, each bit of which is applied to the D input of one of the flip-flops 91. The C (clock input of each latch is strobed by one of the lines 16 (see FIG. 1) which also energize the columns of matrix 18. Each one of the latches 90 corresponds to a different footage, as does each matrix column line 16, and each latch 90 is clocked by the particular line 16 which corresponds to the same footage, so that each latch is loaded only at the precise time when the data word appearing cable 32 is the one which represents the volume for the appropriate footage.

In accordance with the well known characteristics of the D-type flip-flop, the Q output state matches whatever the D input state happens to be at the time of the C input. Thus each latch 90 reads out, on Q output lines 92, a four bit digital word representing the volume chosen for the particular footage. That data is presented to respective digital/analog converters 34*a*, each of which could most economically comprise a conventional binary-weighted ladder network including an operational amplifier 94, ladder resistors 96 having values in the binary proportions R:2R:4R:8R, and a feedback resistor 98 having the value R. Each D/A converter 34*a* produces a voltage level on its output line 40 which represents the selected volume in analog form. Because of the storage characteristic of the latch circuits 90, the analog voltage output of each D/A converter 34*a* persists as long as the associated latch 90 is not reset. Thus in this embodiment there is no need for capacitive storage of the analog voltage information, and the voltage holding capacitors 42 of FIGS. 1 and 3 can therefore be eliminated.

The output lines from the D/A converters 34*a* correspond to lines 40 of FIG. 1, and are similarly gated by respective FET switches 44 under control of the output lines 50 from individual stages of the pitch shift register 51 (FIG. 1). The FET switch outputs are brought to the common buffer 46 and the common PPM/PAM date output line 48 just as in FIG. 1.

Figure 3:
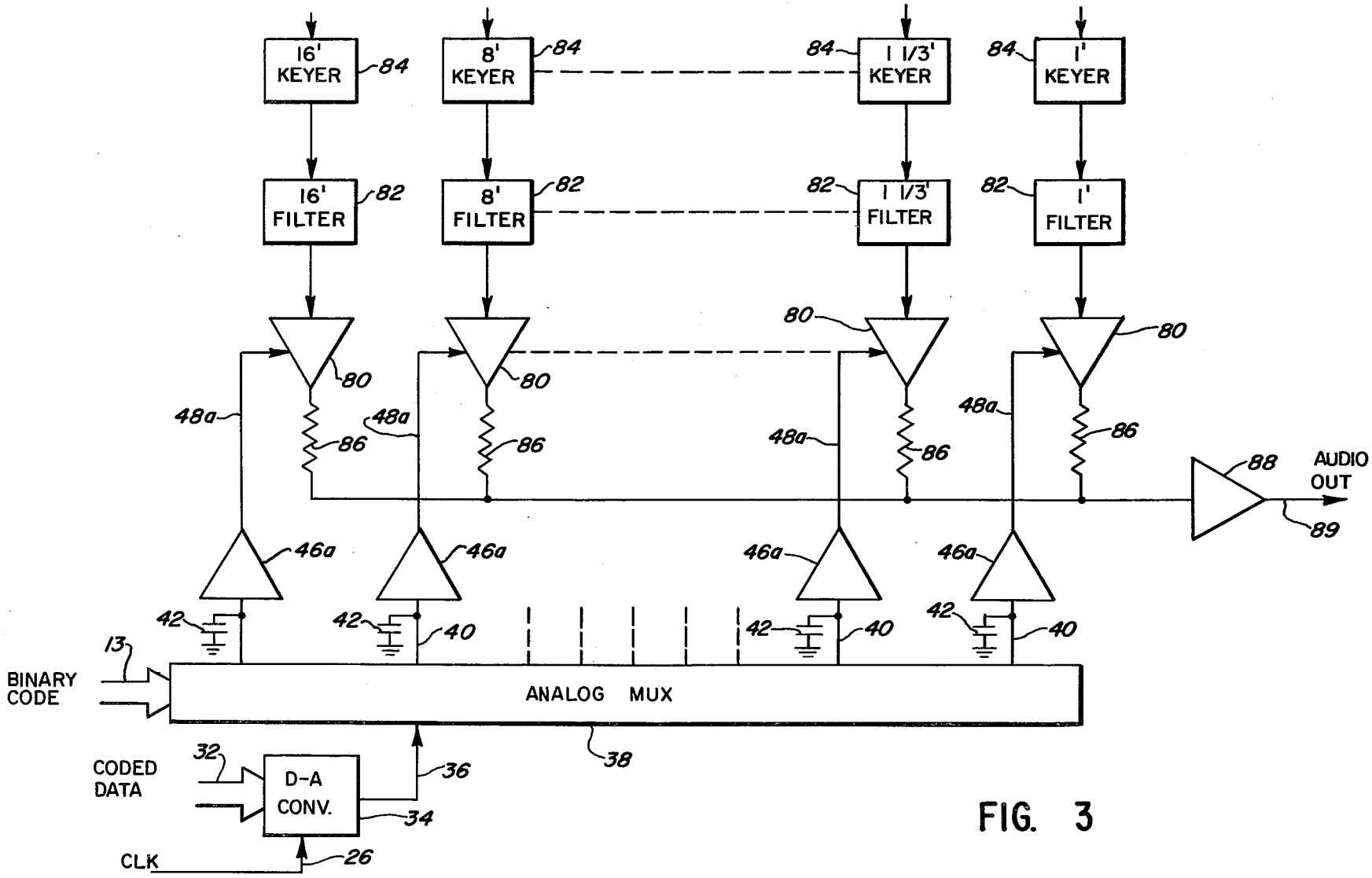

Instead of controlling pulse amplitude in a PAM system, wherein such amplitude in turn governs sound volume, this invention can be used to control the sound volume directly, as illustrated in FIG. 3. In a sense FIG. 3 merely shows an alternative means of utilizing the outputs of the voltage-holding capacitors 42. But here the capacitor voltages do not control sound volume indirectly by means of the pulse amplitudes in a PAM system; instead, they control audio amplitude directly. In FIG. 3 the capacitor voltages are not AND'ed to a single buffer 46 and output line 48, as they are in FIG. 1. On the contrary, here each capacitor voltage goes to an individual buffer 46*a* and an individual line 48*a*. The lines 48*a* go to the gain control ports of respective variable gain amplifiers 80. Each of these amplifiers provides direct amplification for the audio output waveform of one of the footages listed in the table above. (Note that the input to each amplifier 80 comes directly from the filter 82 and keyer 84 for a respective footage.) Thus the volume of each footage depends on the signal applied to its gain control port by line 48*a*, and that in turn depends on the voltage stored on the relevant capacitor 42. The audio outputs of the amplifiers 80 are coupled by individual resistors 86 to a common mixer 88 and audio output line 89.

The advantages of this drawbar (or footage volume control) circuit can now be appreciated. The present circuit makes as many different volume settings available for each footage as there are rows in the switch matrix 18; and each of these volume settings is exactly reproducible at a later time because it is digitally selected by the setting of specific switches in the matrix, rather than by sliding analog adjustment of a potentiometer tap. In addition, many different sets of footage/volume correlations, as many as there are memory switches 60, can be stored and recalled for later use without duplication of labor or risk of inaccuracy in the settings.

The invention, which has been described only by way of example in this specification, is stated more broadly in the appended claims, which indicate the range of structural variations comprehended within its teaching.

What is claimed is:

1. A programmable source of analog information comprising:

a matrix having a plurality of switches distributed along a first axis and along a second axis;

the switches distributed along said second matrix axis corresponding to respective different pulse amplitudes;

scanning means for interrogating successive groups of said matrix switches, the switches of any one group all having the same position along said first matrix axis;

a read/write digital memory having a plurality of addresses;

switch means for selecting among different groups of said memory addresses;

means responsive to said scanning means to write data into and read data out of successive memory addresses in the currently selected group of memory addresses during write cycles and read-out cycles of said memory respectively;

means responsive to said scanning means for entering the successive pulse amplitude values obtained from said matrix into successive ones of the currently selected group of memory addresses in digital form during write cycles of said memory;

and digital-to-analog converter means responsive to read-out cycles of said memory to translate each of the pulse amplitudes specified in said successive memory addresses from digital to voltage analog form.

2. A programmable source as in claim 1 wherein:

said means responsive to said scanning means to write data into and read data out of the currently selected group of memory addresses comprises code detector means arranged to detect a switch closure within said matrix and to produce a write cycle instruction in response thereto;

said memory being normally in a read-out mode, and switching into a write mode in response to said write cycle instruction from said code detector means.

3. A pulse-amplitude-modulation data system employing the programmable source of claim 1 to control pulse amplitude; said system comprising:

means for making the amplitude of successive data pulses produced by said pulse-amplitude-modulation data system proportional to the items of voltage analog information successively provided by said digital-to-analog converter means.

4. A pulse-amplitude-modulation system as in claim 3 wherein said means for proportioning the amplitude of successive data pulses comprises:

a plurality of voltage holding capacitors respectively corresponding to said successively interrogated groups of matrix switches;

an analog multiplexer responsive to said scanning means to receive the items of voltage analog information successively available from said digital-to-analog converter means, and distribute them to respective ones of said voltage holding capacitors in a sequence corresponding to successively interrogated groups of matrix switches;

pulse amplitude data output means;

and electronic switching means responsive to said scanning means to connect said voltage holding capacitors successively to said output means.

5. A pulse-amplitude-modulation system as in claim 4 wherein said electronic switching means comprises:

a pulse-position-modulation data source;

a shift register effective to shift data received from said PPM data source, and having a plurality of output lines emanating from respective shift stages corresponding to respective pulse time positions of said PPM data source;

and a plurality of electronic switches connected to couple respective voltage holding capacitors to, and decouple them from, said pulse amplitude data output means;

said electronic switches having respective control terminals connected to respective shift register output lines.

6. A pulse-amplitude-modulation system as in claim 3 wherein said means for proportioning the amplitude of successive data pulses comprises:

a plurality of latches each capable of storing a digital word received from said memory, said latches respectively corresponding to said successively interrogated groups of matrix switches;

means connecting said latches to said scanning means for enabling each of said latches in synchronism with the interrogation of the corresponding group of matrix switches;

means for loading the digital output of said memory into the currently enabled one of said latches;

said digital-to-analog converter means comprising a plurality of individual digital-to-analog converter circuits each responsive to the output of one of said latches to convert the digital information therein to voltage analog form;

pulse amplitude data output means;

and electronic switching means operative to connect said digital-to-analog converter circuits successively to said output means.

7. A pulse-amplitude-modulation system as in claim 6 wherein said electronic switching means comprises:

a pulse-position-modulation data source;

a shift register effective to shift data received from said PPM source, and having a plurality of output lines emanating from respective shift stages corresponding to respective pulse time positions of said PPM data source;

and a plurality of electronic switches connected to couple respective digital-to-analog converter circuits to, and decouple them from, said pulse amplitude data output means;

said electronic switches having respective control terminals connected to respective shift register output lines.

8. A pulse-amplitude-modulation system as in claim 6 wherein said digital-to-analog converter circuits comprise respective binary-weighted ladders.

9. An electronic musical instrument employing the programmable source of claim 1 to control sound volume, said instrument comprising:

a plurality of audio waveform channels each including a variable gain amplifier having a gain control port;

and means coupling the items of voltage analog information successively provided by said digital-to-analog converter to respective ones of said amplifier gain control parts.

10. An electronic musical instrument as in claim 9 wherein said voltage analog information coupling means comprises:

a plurality of voltage holding capacitors respectively corresponding to said successively interrogated groups of matrix switches;

an analog multiplexer responsive to said scanning means to receive the items of voltage analog information successively available from said digital-to-analog converter means, and distribute them to respective ones of said voltage holding capacitors in a sequence corresponding to successively interrogated groups of matrix switches.

11. A programmable source as in claim 1 further comprising:

a digital display;

drive means responsive to said scanning means to energize said display in synchronism therewith;

and decoding means responsive to the read output of said memory to cause said display to read out the data correlations currently in use.

12. A programmable source as in claim 1 wherein:

said scanning means comprises a clock source, a scan counter driven by said clock source, and a decoder responsive to the output of said counter to energize said successive groups of matrix switches.

13. A programmable source as in claim 12 wherein:

said memory is responsive to said counter output during both read and write cycles to enter data into and read data out of the currently selected group of memory addresses in an order corresponding to said successively interrogated groups of matrix switches.

14. A programmable source as in claim 12 further comprising:

a plurality of voltage holding capacitors;

and an analog multiplexer responsive to said counter output to select said voltage holding capacitors for connection to said digital-to-analog converter in an order corresponding to said successively interrogated groups of matrix switches.

15. In an electronic musical instrument, a programmable source of footage volume information comprising:

a matrix having a plurality of switches distributed along a first axis and along a second axis;

the switches distributed along said second matrix axis corresponding to respective different sound volumes;

the switches distributed along said first matrix axis corresponding to respective different footages;

scanning means for interrogating successive groups of said matrix switches, the switches of any one group all representing the same footage;

a read/write digital memory having a plurality of addresses;

switch means for selecting among different groups of said memory addresses;

means responsive to said scanning means to write data into and read data out of successive memory addresses in the currently selected group of memory addresses during write cycles and read-out cycles of said memory respectively;

means responsive to said scanning means for entering the successive sound volume values obtained from said matrix into successive ones of the currently selected group of memory addresses in digital form during write cycles of said memory;

and digital-to-analog converter means responsive to read-out cycles of said memory to translate each of the sound volumes specified in said successive memory addresses from digital to voltage analog form.

* * * * *